US005301886A

United States Patent [19]

Kathke et al.

[11] Patent Number: 5,301,886

[45] Date of Patent: Apr. 12, 1994

[54] METHOD AND APPARATUS FOR WINDING TEXTILE YARN FROM A SUPPLY PACKAGE ONTO A TAKE-UP PACKAGE INCLUDING RESPONDING TO A FALSELY REPORTED YARN BREAK SITUATION

[75] Inventors: Gregor Kathke, Viersen; Rolf Haasen, Moenchengladbach; Heribert Kargel, Viersen, all of Fed. Rep. of Germany

[73] Assignee: W. Schlafhorst AG & Co., Moenchengladbach, Fed. Rep. of Germany

[21] Appl. No.: 985,561

[22] Filed: Dec. 3, 1992

[30] Foreign Application Priority Data

Dec. 4, 1991 [DE] Fed. Rep. of Germany ..... 4139892

[51] Int. Cl.[5] ..... B65H 54/22

[52] U.S. Cl. ..... 242/35.6 R

[58] Field of Search ..... 242/35.6 R, 36, 37 R, 242/39, 35.5 R, 18 R

[56] References Cited

U.S. PATENT DOCUMENTS

| | | | |
|---|---|---|---|
| 3,918,651 | 11/1975 | Uchida | 242/35.6 R |
| 4,432,197 | 2/1984 | Ueda et al. | 57/261 |
| 4,804,151 | 2/1989 | Kathke | 242/35.6 R |
| 4,988,050 | 1/1991 | Tone | 242/35.6 R |

*Primary Examiner*—Stanley N. Gilreath

*Attorney, Agent, or Firm*—Shefte, Pinckney & Sawyer

[57] ABSTRACT

The present invention provides a method and apparatus for operating a textile winding machine to wind yarn packages with the capability to verify a reported yarn break situation and to respond accordingly in the event that a yarn break has not, in fact, occurred. A sensing device at a textile winding station senses the travel of a yarn therepast as the yarn is wound from a supply package onto a take-up package. In the event of a yarn break or movement of the yarn beyond the sensing range of the sensing device, the sensor reports the absence of yarn to a control unit. The control unit responds to the signal from the sensing device by stopping the yarn winding operation and implementing a yarn re-establishment operation. The yarn re-establishment operation includes monitoring the position of a yarn end engaging member during its movement toward one of the yarn packages and querying the sensing device at a predetermined time determined in correspondence with the position of the yarn end engaging member as to the presence or absence of yarn. If the presence of yarn is reported, the control unit controls a yarn cutting device to cut the yarn ends and subsequently controls a splicing device to splice the yarn ends together. If the absence of yarn is reported, the control unit controls the yarn end engaging members to dispose yarn ends in the splicing device without any cutting of the yarn.

16 Claims, 5 Drawing Sheets

METHOD AND APPARATUS FOR WINDING TEXTILE YARN FROM A SUPPLY PACKAGE ONTO A TAKE-UP PACKAGE INCLUDING RESPONDING TO A FALSELY REPORTED YARN BREAK SITUATION

BACKGROUND OF THE INVENTION

In one well-known arrangement for operating a textile winding station of a textile winding machine, a sensing device is provided for sensing the presence and quality of a yarn being wound from a supply package onto a take-up package such as, for example, a cross wound package. In the event that the sensing device senses an out-of-limits condition such as, for example, a portion of the yarn which does not meet the quality requirements, the defective portion of the yarn is severed and removed while the two yarn ends created by the severing process are spliced together and the yarn winding operation is then resumed. In addition to deliberately initiating severing of the yarn such as just described, the yarn itself may break due to a weak defective portion of the yarn and, in such circumstances, the sensing device senses that the yarn is no longer traveling through the sensing area and alerts a control unit which shuts down the yarn winding operation. Typically, a winding re-establishment procedure is then implemented by which a yarn end from the take-up package and a yarn end from the supply package are spliced together so that the yarn winding operation can be restarted.

One such out-of-limits operational condition is a condition in which the yarn has moved out of its normal travel path which extends within the sensing range of the sensing device, although the yarn still extends between the supply package and the take-up package. Such an out-of-limits operational condition may occur if debris or other matter accumulates on the yarn or on a component of the textile winding machine over which the yarn travels, which may lead to a situation in which the yarn moves away from the surfaces of the textile winding machine which normally guide the yarn during its travel without, however, causing a yarn break. However, once the yarn moves beyond the sensing range of the sensing device, the sensing device transmits a signal to the control unit of the textile winding machine which shuts down the yarn winding operation. Unfortunately, a textile winding station which does not possess the capability to distinguish between a true yarn break situation and another shutdown-causing situation in which the yarn has not broken will react to a signal from the sensing device as if a true yarn break has occurred and this approach does not guarantee that the actual out-of-limits operational condition will be remedied.

Other out-of-limits operational conditions which may lead to a shutdown of the yarn winding operation include the occurrence of electrical disturbances such as, for example, fluctuations of at least a certain magnitude in the electrical power system leading to fluctuations in the voltage supply to the sensor. Another out-of-limits operational condition is the accumulation of dirt or debris on or in the vicinity of the sensing device which causes the sensing device to falsely conclude that it has detected a defective portion of the yarn traveling therepast. Such a situation may occur, for example, during the passage through the sensing device of a so-called core yarn which does not have fibers wound around it but, instead, is merely a blank strand of material which, as a rule, is a monofilament. A sensing device which is covered or clouded by dust or debris may falsely conclude that no yarn is present when, in fact, the core yarn is traveling through the sensing device. As a result, the control unit will shut down the yarn winding operation at the textile winding station on the assumption that a yarn break has occurred when, in fact, no yarn break has occurred.

In U.S. Pat. No. 4,804,151, a yarn severing operation is disclosed in which a yarn severing device severs a yarn extending between a supply package and a take-up package during a shutdown of the textile winding station independent of the reason for the shutdown of the textile winding station. In this arrangement, each time the textile winding station is shut down, the yarn severing device is operated to sever the yarn and, subsequently, the two yarn ends created by the yarn severing process are then spliced together. The yarn severing process is implemented even if the shutdown of the textile winding station is not due to any defect in the yarn but, instead, is due to some other reason. However, if the reason for the shutdown of the textile winding station is due to an out-of-limits operational condition other than a defect in the yarn, merely severing the yarn and splicing the yarn ends together may not remedy the out-of-limits operational condition and, upon restarting of the yarn winding operation, another shutdown of the textile winding station will occur very shortly after the restarting. Accordingly, the need exists for an improved method and apparatus for re-establishing a yarn winding operation at a textile winding station after a yarn winding operation has been stopped due to the detection of an out-of-limits operational condition.

SUMMARY OF THE INVENTION

Briefly described, the present invention provides in one aspect thereof, a method of operating a textile winding station to wind yarn packages, the textile winding station being operable to unwind yarn from a supply package onto a take-up package during a yarn winding operation. The method includes winding yarn from the supply package onto the take-up package in a yarn winding operation which includes guiding yarn relative to a sensing device during its travel from the supply package to the take-up package for sensing of the presence of the yarn and ceasing the winding of yarn from the supply package to the take-up package in response to the sensing of an out-of-limits condition of the yarn by the sensing device. Also, the method includes initiating movement of a yarn end engaging member toward a yarn engaging position for subsequent engagement of a yarn end extending from a respective one of the supply and take-up packages following the ceasing of the winding of yarn. The method further includes controlling the yarn end engaging member to engage yarn while the yarn end engaging member is disposed in its yarn end engaging position such that the yarn end engaging member draws in a portion of a yarn which extends to both the supply package and the take-up package in the event the yarn is still in an unbroken condition after the ceasing of the winding of yarn or draws in a yarn end from the respective one package in the event that the yarn is in a broken condition after the ceasing of the winding.

Moreover, the method includes preliminarily sensing the presence or absence of yarn at a sensing location after initiating movement of the yarn end engaging member toward its yarn engaging position and before orientation of a yarn in a splicing device for splicing a yarn end extending from the supply package together with a yarn end extending from the take-up package. If no yarn is preliminarily sensed during the preliminarily sensing of yarn, the method includes orienting the yarn end extending from the one respective package into the yarn end engaging member in the splicer, orienting a yarn end from the other package in the splicer and splicing the pair of oriented yarn ends in the splicer together to restore the yarn to an unbroken condition. However, if yarn is sensed during the preliminary sensing of yarn, cutting the unbroken yarn extending between the supply and take-up packages to thereby create a pair of yarn ends each extending from a respective package, the method includes orienting the pair of yarn ends in the splicer and operating the splicer to splice the oriented yarn ends together to again restore the yarn to its unbroken condition.

According to one feature of the one aspect of the present invention, the method additionally includes detecting a positional characteristic of the yarn end engaging member and preliminarily sensing the presence or absence of yarn at the sensing location in response to the detection of a predetermined value of the positional characteristic of the yarn end engaging member. Preferably, the step of detecting a positional characteristic of the yarn end engaging member includes sensing the presence or absence of the yarn end engaging member at a predetermined position. According to another detail of the one feature of the one aspect of the present invention, the step of detecting a positional characteristic of the yarn end engaging member includes detecting a characteristic of an incremental position indicating device which moves in correspondence with the movement of the yarn end engaging member.

According to another feature of the one aspect of the present invention, the step of preliminarily sensing the presence or absence of yarn includes preliminarily sensing such presence or absence or yarn during a period of time commencing upon the movement of the yarn end engaging member from a first predetermined position and ending upon the movement of the yarn end engaging member past a second predetermined position. Alternatively, according to a further feature of the one aspect of the present invention, the step of preliminarily sensing the presence or absence of yarn includes sensing the presence or absence or yarn for a period of time corresponding to the period of time during which the yarn end engaging member is disposed in a predetermined position. Preferably, the step of preliminarily sensing the presence or absence of yarn is conducted for a period of time corresponding to the period of time during which the yarn end engaging member is disposed at its yarn end engaging position.

According to a further preferred feature of the one aspect of the present invention, the yarn end engaging member is operable to engage a yarn end on the take-up package and preliminarily sensing the presence or absence of yarn includes sensing the presence or absence of yarn following the positioning of the yarn end engaging member in its yarn end engaging position adjacent the take-up package.

According to another aspect of the present invention, there is provided an apparatus for winding yarn from a supply package onto a take-up package. The operation includes means for rotating a take-up package to wind yarn thereon from a supply package and a splicing device for splicing a yarn end extending from the take-up package with a yarn end extending from the supply package. Also, the apparatus includes a sensing device for sensing the travel of yarn therethrough during travel of the yarn between the supply package and the take-up package and means for cutting yarn extending between the take-up package and the supply package.

The operation further includes a take-up yarn end engaging member for engaging a yarn end extending from the take-up package and disposing the yarn end in the splicing device for splicing with a yarn end extending from the supply package. The take-up yarn end engaging member is sequentially movable from a non-engagement position in which it is out of interference with the yarn during travel thereof from the supply package to the take-up package to a yarn end engaging portion adjacent the take-up package for engaging a yarn end thereof, and subsequently to a splicer orienting position in which it disposes a yarn end engaged from the take-up package in the splicing device. Also, the apparatus includes a supply yarn end engaging member for engaging a yarn end extending from the supply package and disposing the engaged yarn end in the splicing device for splicing with a yarn end extending from the take-up package and means for controlling the yarn cutting device to cut the yarn in response to a signal from the sensing device indicating the presence of yarn at a time after the take-up yarn end engaging member has moved from its non-engagement position and before it has reached its splicer orienting position.

According to one feature of the another aspect of the present invention, the means for controlling the yarn cutting device includes means for controlling the yarn cutting device to cut the yarn in response to a signal from the sensing device indicating the presence of yarn at a time when the take-up yarn end engaging member is disposed in its yarn end engaging position.

According to another feature of the another aspect of the present invention, the apparatus additionally includes means for detecting the disposition of the take-up yarn end engaging member at a predetermined location. Preferably, the disposition detecting means includes a detecting device positioned adjacent a predetermined extent of the travel path of the selected one yarn end engaging member and operatively connected to the means for controlling the yarn cutting device to signal the presence of the selected one yarn end engaging member thereat.

According to further details of the another feature, the apparatus also includes a pair of cams, each operatively connected to a respective one of the yarn end engaging members and the disposition detecting means includes means for detecting the position of at least one of the cams, the cam position detecting means being operatively connected to the means for controlling the yarn cutting device, and the means for controlling the yarn cutting device being operable to control the yarn cutting device to cut the yarn in response to a signal from the cam position detecting means.

According to an additional feature of the another aspect of the present invention, the take-up yarn end engaging member includes a guide contour for guiding a yarn to a travel path along which the yarn normally travels during a yarn winding operation.

DESCRIPTION OF THE PREFERRED EMBODIMENT

Figure 1:
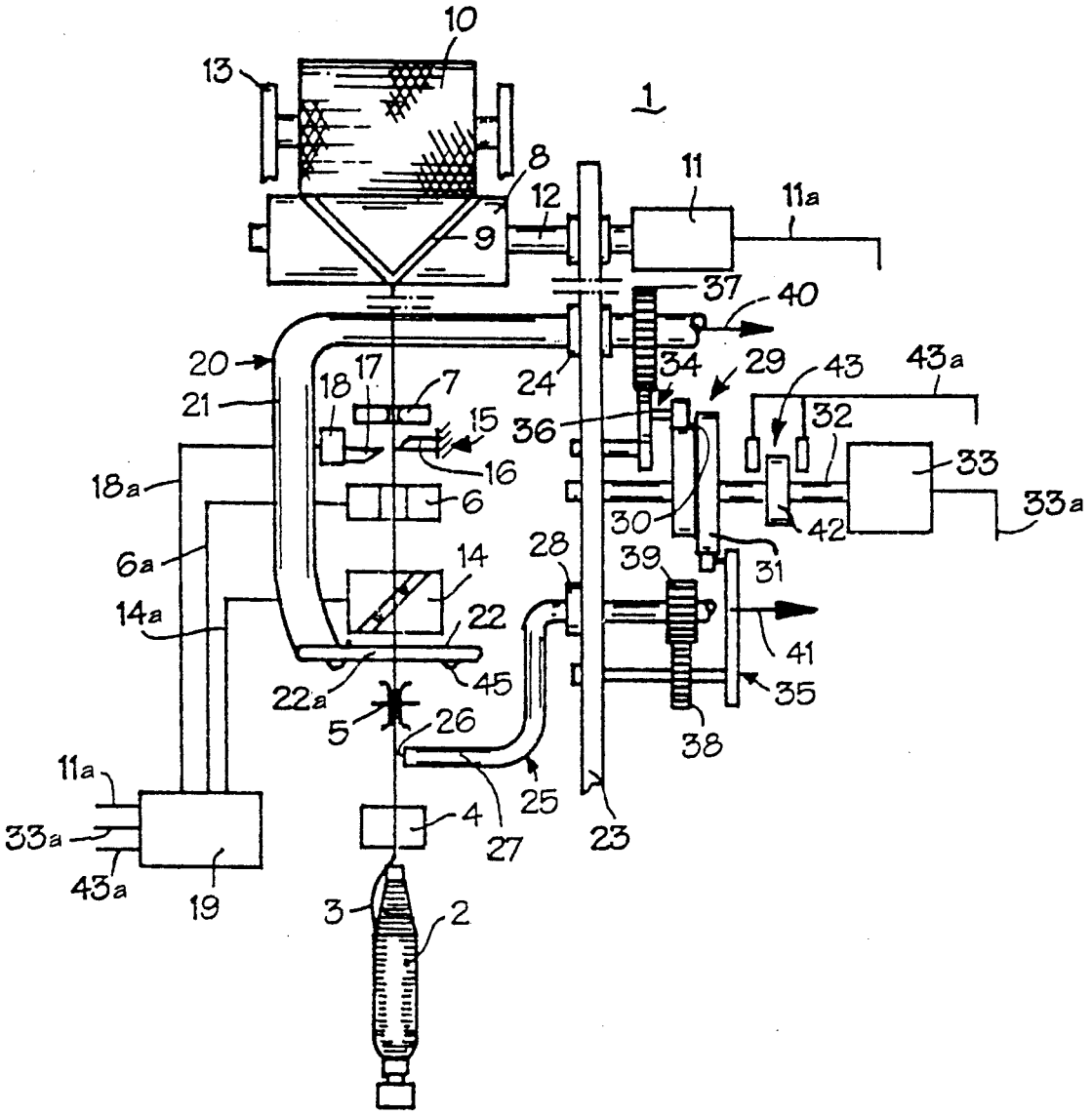
FIG. 1 is a front elevational view of a portion of a textile winding station of a textile winding machine incorporating the preferred embodiment of the yarn break verification apparatus of the present invention.

In FIGS. 1–6, the preferred embodiment of the yarn break verification apparatus of the present invention is illustrated in its operational position for re-establishing a yarn winding operation at a textile winding station following a purported yarn break thereat. As seen in FIG. 1, the textile winding station 1 includes a number of components which are commonly found on textile winding stations as well as the yarn operation re-establishment apparatus of the present invention. A supply-type yarn package 2 is supported in conventional manner such as, for example, in an upright disposition on a tube support member or caddy, as the yarn 3 of the yarn package is unwound from the yarn package and wound onto a take-up package 10, which is rotatably supported on a take-up package frame 13. During its travel from the supply package 2 to take-up package 10, the yarn 3 sequentially travels through a draw-off accelerator 4, a yarn tension device 5, a so-called electronic yarn cleaning device 6, a yarn guide 7, and a traverse winding drum 8.

The traverse winding drum 8 has a plurality of grooves 9 in which the yarn 3 travels and the grooves traversely move the yarn 3 as it is wound on the take-up package 10 which is being formed as a so-called cross-wound package. The traverse winding drum 8 is mounted on a shaft 12 which is rotatably driven by a drive motor 11. The drive motor 11 is operatively connected via a connector 11*a* to a control unit 19. Other elements of the textile winding station are also operatively connected to the control unit 19 for control thereby. The electronic yarn cleaning device 6 is operatively connected via a connector 6*a* to the control unit 19 and, among other functions, the connector 6*a* transmits signals from a sensor mounted in the electronic yarn cleaning device 6 which is operable to sense the presence or absence of a yarn in the 6.

Other components of the textile winding station 1 are positioned relative to the travel path of the yarn 3 during its travel between the supply package 2 and the take-up package 10, although these other components typically are not in engagement with the yarn 3 during its normal travel in a yarn winding operation but, instead, are operated in special circumstances such as in the event that a break in the yarn 3 has occurred and a yarn winding re-establishment operation has been initiated to reinitiate or establish the winding operation. These other components include a yarn cutting device 15 having a stationary or anvil portion 16 fixedly mounted to the frame of the textile winding station 1 and a complementary movable portion 17 operatively connected to an actuation device 18 which extends the movable portion 17 toward the anvil portion 16 to effect cutting of the yarn therebetween. The actuation device 18 is operatively connected via connector 18*a* to the control unit 19, which controls the actuation device 18 to extend the movable portion 17 in a yarn cutting operation in response to the occurrence of several situations. One such situation is the occurrence of an out-of-limits condition of the yarn 3 such as, for example, a portion of the yarn 3 being too thick and this out-of-limits condition is detected by a sensor of the electronic yarn cleaning device 6 and signaled via the connector 6*a* to the control unit 19. The control unit 19 then controls the actuation device 18 to effect a yarn cutting operation and the overly thick portion of the yarn 3 is then cut and removed and the severed yarn ends are reconnected via a splicing operation to again place the yarn 3 in condition for resumption of the yarn winding operation.

To connect or splice together a yarn end extending from the take-up package 10 and another yarn end extending from the supply package 2, the textile winding station 1 includes a splicing device 14 operatively connected via a connector 14*a* to the control unit 19. The textile winding station 1 additionally includes components for engaging yarn ends on each of the supply package 2 and take-up package 10, positioning engaged yarn ends for sensing and subsequently positioning engaged yarn ends in the splicing device 14 for splicing together of the two yarn ends. These components include an upper yarn or take-up package yarn end engaging member 20 having a conduit 21 rotatably mounted via a rotation coupling 24 to a wall 23 of the textile winding station 1 and a lower yarn or supply package yarn engaging member 25 having a conduit 27 rotatably mounted in the wall 23 by a rotation coupling 28. The conduit 27 includes a suction mouth 26 through which suction is applied to the portion of the travel path of the yarn 3 intermediate the draw-off accelerator 4 and the yarn tension device 5 for engaging a yarn end of the yarn 3 extending from the 2.

The free end of the conduit 21 is formed as a relatively flat, wide-mouthed suction applying mouth 22 having an opening 22*a* of a longitudinal extent generally corresponding to the longitudinal extent of the take-up package 10. The take-up package yarn end engaging member 20 is normally disposed in a position in which the suction applying mouth 22 is out of interference with yarn 3 traveling between the supply package 2 and the take-up package 10 with the yarn 3 disposed intermediate the splicing device 14 and the yarn cleaner 6 relative to the direction of travel of the yarn 3. The conduit 21 is rotatable relative to the rotation coupling 24 to bring the suction applying mouth 22 closely adjacent the take-up package 10 for applying suction thereto to engage a yarn end from the take-up package 10 and is pivotable downwardly to dispose an engaged yarn end in the electronic yarn cleaning device 6 and the splicing device 14 for splicing thereof with a yarn end from the 2, as will be described in more detail below.

Figure 5:
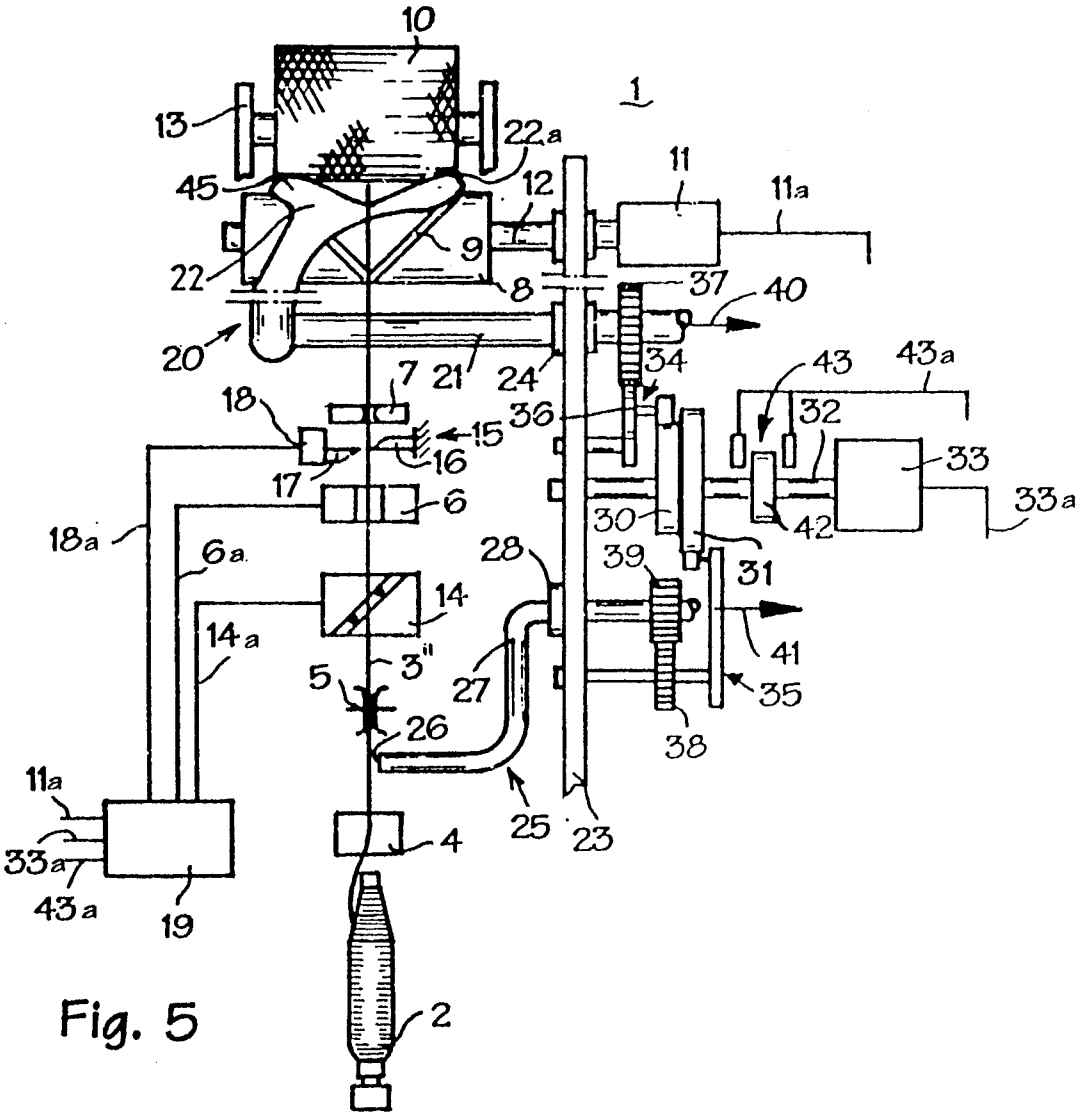
FIG. 5 is a front elevational view of the portion of the textile winding station shown in FIG. 4.

With reference to FIG. 5, it can be seen that the suction applying mouth 22 of the take-up package yarn end engaging member 20 is formed with a guide contour 45 having a predetermined curvature and comprising a pair of concave projections, each located adjacent a respective longitudinal end of the opening 22*a* and interconnected via a convex portion. The concave and convex portions cooperate with one another, as described in more detail below, to guide an errant or offset yarn 3 to an aligned position.

The conduit 21 extends through the rotation coupling 24 to the other side of the wall 23 and is operatively connected on the other side of the wall 23 to a suction source (not shown) which applies suction through the conduit 21 in the direction indicated by the arrow 40 in FIG. 1. The pivoting of the conduit 21 in a controlled manner is accomplished via a cam assembly 29 which includes a driven gear 37 co-axially mounted on the portion of the conduit 21 extending on the other side of the wall 23 and driven by a drive gear 36 having a plurality of gear teeth along a portion of its periphery which are supported in meshing engagement with the teeth of the driven gear 37 and driven by the rotational mounting of the transmission gear assembly 34 in the wall 23. The transmission gear assembly 34 also includes a cam following portion which extends into cam following engagement with an upper yarn cam 30 fixedly mounted to a shaft 32. The shaft 32 is rotatably supported in the wall 23 and is operatively connected to a cam drive motor 33, which is operatively connected via connector 33*a* to the control unit 19. A lower yarn cam 31 is also fixedly mounted to the shaft 32. The supply package yarn engaging member 25 extends through the rotation coupling 28 to the other side of the wall 23 and is operatively connected to a suction source (not shown), which applies suction through the conduit 27 in the direction indicated by the arrow 41 in FIG. 1. A driven gear 39 is mounted to the portion of the conduit 27 extending on the other side of the wall 23. A transmission gear assembly 35 includes a shaft rotatably mounted in the wall 23 and having a drive gear 38 fixedly mounted thereon which is in meshing engagement with the driven gear 39. The transmission gear assembly 35 also includes a cam follower portion which is supported in cam following engagement with the lower yarn cam 31.

Figure 4:
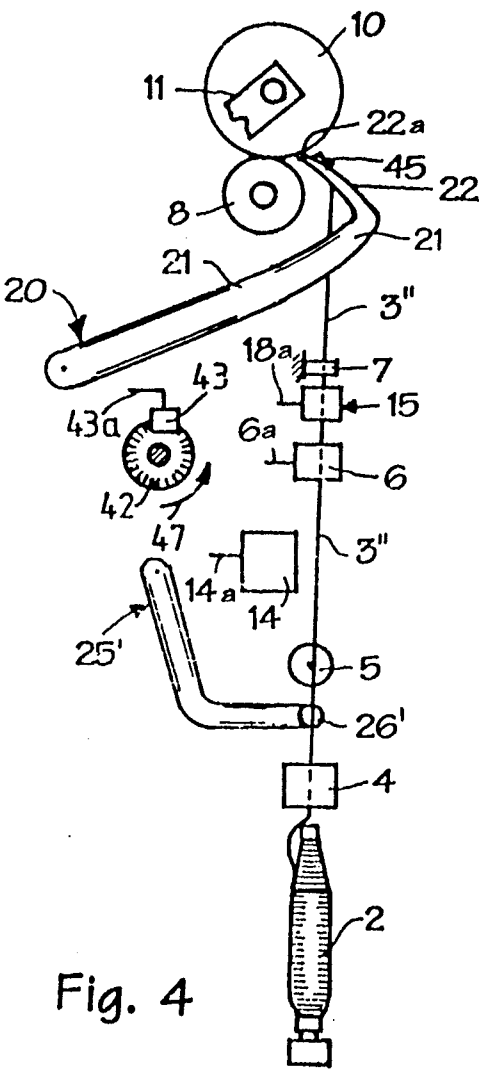
FIG. 4 is a side elevational view of the portion of the textile winding station shown in FIG. 3 at the time of an attempt to engage a yarn end of the take-up package by the take-up package yarn end engaging member.

Since the upper yarn cam 30 and the lower yarn cam 31 are commonly mounted to the shaft 32, rotation of the shaft 32 by the cam drive motor 33 effects movement of both cams and corresponding cam following movement of the transmission gear assemblies 34, 35 which, in turn, pivot the take-up package yarn end engaging member 20 and supply package yarn engaging member 25, respectively, to and between their various positions. To monitor selected characteristics of the pivotal movement of the take-up package yarn end engaging member 20 and the supply package yarn engaging member 25 such as, for example, the direction and magnitude of pivoting, so as to provide information for use in verifying the occurrence of a yarn break, the present invention provides a pivotal movement measuring device 43 which is in the form of a disk 42 co-axially mounted to the shaft 32 and a pair of disk readers operatively connected via a connector 43*a* to the control unit 19 and disposed for sensing the direction and magnitude of rotation of the disk 42, which is rotated in correspondence with the rotation of the upper yarn cam 30 and lower yarn cam 31 by the shaft 32. The disk 42 has a plurality of uniformly angularly spaced markings along its opposed cylindrical surfaces and each of the readers is operable to "read" or sense the movement and number of markings on a respective cylindrical surface of the disk 42 as the disk 42 is rotated. For example, as seen in FIG. 4, one of the disk readers of the pivotal movement measuring device 43 is operable to "read" or sense the movement and number of markings on the disk 42 as the disk 42 rotates in a rotation direction indicated by the arrow 47.

During a yarn winding operation, as seen in FIG. 1, the traverse winding drum 8 continuously rotates the take-up package 10 and feeds the yarn 3 thereon in a traversing manner to build the take-up package 10 into a complete cross-wound package. As the yarn 3 is drawn off the supply package 2, it sequentially passes through the draw-off accelerator 4, the yarn tension device 5, the 6, and is guided by the yarn guide 7 as it travels therepast toward the traverse winding drum 8. Both the take-up package yarn end engaging member 20 and the supply package yarn engaging member 25 are pivoted to their respective non-operational positions in which the suction applying mouth 22 of the take-up package yarn end engaging member 20 is adjacent, yet spaced from, the portion of the travel path of the yarn 3 between the yarn cleaner 6 and the splicing device 14 and the suction mouth 26 of the supply package yarn engaging member 25 is disposed adjacent, yet spaced from, the portion of the travel path of the yarn 3 between the yarn tension device 5 and the 4. The sensor in the electronic yarn cleaning device 6 continuously monitors the presence of the yarn 3 as it travels therethrough.

While the yarn 3 is sometimes deliberately cut to remove an out-of-limits portion such as, as discussed above, an overly thick portion, other events often occur during a yarn winding operation which are, at least initially, evaluated as a break in the yarn 3 and the yarn winding operation is ceased in response to the actual or purported yarn break. The cessation of the yarn winding operation is implemented by the control unit 19, which controls the shutdown of the rotation of the traverse winding drum 8 in response to a signal from the sensor of the electronic yarn cleaning device 6 indicating the yarn 3 is not present. The absence of the yarn 3 detected by the sensor of the electronic yarn cleaning device 6 is attributable to one of two causes: either the yarn 3 has, in fact, experienced a yarn break, in which event one yarn end extends from the take-up package 10 and another yarn end extends from the supply package 2, or no break in the yarn 3 has, in fact, occurred, yet the yarn 3 has moved beyond the sensing range of the sensor in the 6.

Figure 2:
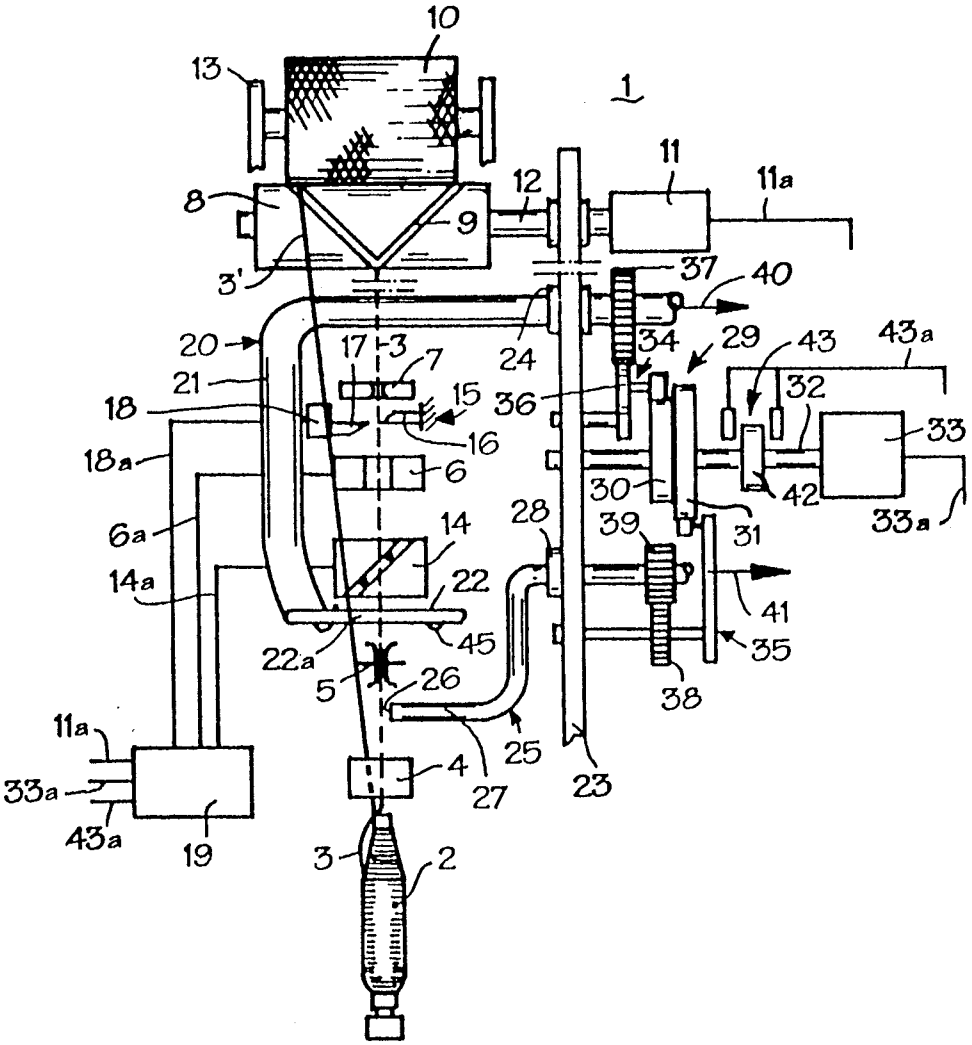
FIG. 2 is a front elevational view of the portion of the textile winding station shown in FIG. 1 following a cessation of a yarn winding operation which has been falsely evaluated as a yarn break situation.

FIG. 2 exemplarily illustrates a situation attributable to the latter cause—namely, the yarn 3 has moved beyond the sensing range of the sensor in the electronic yarn cleaning device 6 and now extends along an offset travel path yarn 3' between the supply package 2 and the take-up package 10. Such errant movement of the yarn 3 may occur, for example, due to a build-up of debris in the grooves 9 of the traverse winding drum 8 to such an extent that the impact of the yarn 3 with the accumulated debris results in displacement of the yarn 3 out of its normal tracking movement along the grooves 9 without, however, causing a break in the yarn 3. Depending upon the elasticity of the yarn and the yarn winding speed, the situation may arise that the yarn 3, once displaced from its normal tracking movement through the grooves 9, does not return to its normal travel path but, instead, remains in the yarn travel path 3'. Due to the offset nature of the yarn travel path 3', no portion of the travel path of the yarn 3 lies within the sensing range of the sensor in the electronic yarn cleaning device 6 and a signal is accordingly transmitted to the control unit 19 via the connector 6a to indicate that the yarn 3 is no longer present. As noted above, the control unit 19 initially evaluates such information as an indication that a break in the yarn 3 has occurred and accordingly implements a cessation of the yarn winding operation and additionally implements a series of steps to automatically re-establish the winding operation. To avoid a failure of the yarn re-establishment operation or another cessation of the yarn winding operation, the method of the present invention advantageously provides a procedure for gathering more accurate information about the reason why the sensor in the electronic yarn cleaning device 6 no longer senses the presence of the yarn 3 so that the control unit 19 can implement an appropriate series of steps to re-establish the yarn winding operation.

In addition to controlling the drive motor 11 by the connector 11a to stop the rotation of the traverse winding drum 8, the control unit 19 controls the cam drive motor 33 via the connector 33a to initiate rotation of the 32 to effect pivoting movement of the take-up package yarn end engaging member 20 and the supply package yarn engaging member 25.

Figure 3:
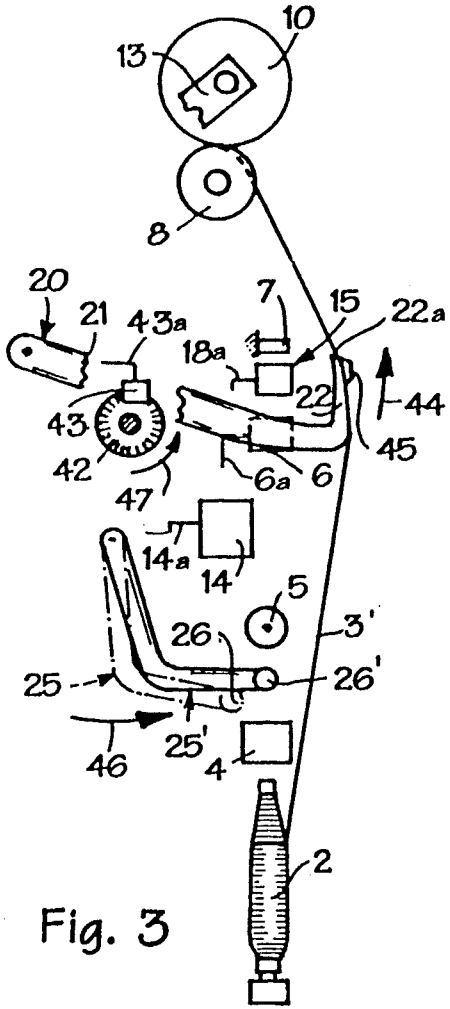
FIG. 3 is a side elevational view of the portion of the textile winding station shown in FIG. 1 at a time during a winding re-establishment operation when the take-up package yarn engaging member is being moved into its yarn engaging position.

As seen in FIGS. 2 and 3, the shaft 32 is rotated by the cam drive motor 33 initially in a counterclockwise direction as indicated by the arrow 47 in FIG. 3 and this counterclockwise rotation of the shaft 32 produces counterclockwise rotation of the upper yarn cam 30 and corresponding rotation, via the driven gear 37, of the conduit 21 in a counterclockwise direction as indicated by the arrow 44 in FIG. 3. Simultaneously, the rotation of the shaft 32 results in corresponding pivoting of the supply package yarn engaging member 25 in a counterclockwise direction as indicated by the arrow 46 in FIG. 3.

The initial pivoting movement of the take-up package yarn end engaging member 20 and the supply package yarn engaging member 25 are the initial components of movement of each yarn engaging member to bring it into position adjacent its respective package 2 or take-up package 10 for engaging a yarn end thereof. To this extent, the control unit control unit 19 is controlling the movement of the components of the textile winding station 1 on the assumption, not yet verified, that an actual yarn break has occurred.

As seen in particular in FIG. 3, as the take-up package yarn end engaging member 20 executes its counterclockwise pivoting movement, the suction applying mouth 22 of the take-up package yarn end engaging member 20 engages the yarn 3, which lies in the yarn travel path 3' following the cessation of the yarn winding operation. The guide contour 45, formed of the concave and convex portions of the suction applying mouth 22, engages the yarn 3 and guides the yarn 3, as the take-up package yarn end engaging member 20 continues to pivot, to a position in which the yarn 3 is again aligned in its normal travel path for a yarn winding operation, as illustrated in FIG. 5. As seen in FIG. 3, movement of the suction applying mouth 22 of the take-up package yarn end engaging member 20 against the yarn 3 produces an outward bowing movement of the yarn 3, which creates some slack in the yarn 3. Accordingly, as the suction applying mouth 22 of the take-up package yarn end engaging member 20 approaches its yarn end engaging position adjacent the take-up package 10 and the suction action through the take-up package yarn end engaging member 20 is initiated, a portion of the yarn 3, due to the slack therein, is drawn into the suction applying mouth 22 by the suction action. The drawing in of the slack portion of the yarn 3 into the suction applying mouth 22 places the yarn 3 again in a generally taut condition as it extends to the supply package 2 and, as discussed above, the action of the guide contour 45 guides the yarn 3 into its normal travel path.

As seen in FIG. 3, during the pivoting movement of the take-up package yarn end engaging member 20 to bring its suction applying mouth 22 into its yarn engaging position adjacent the take-up package 10, the pivotal movement measuring device 43 is operated to sense the angular movement of the disk 42 and this information is provided by the connector 43a to the control unit 19. The control unit 19, in one use of the information provided by the pivotal movement measuring device 43, initiates the application of suction through the suction applying mouth 22 as the suction applying mouth 22 approaches its yarn engaging position based upon the detected angular movement of the disk 42.

As also seen in FIG. 3, the initial pivoting movement of the supply package yarn engaging member 25 in the counterclockwise direction indicated by the arrow 46 results in movement of the suction mouth 26 of the supply package yarn engaging member 25 into its yarn end engaging position between the draw-off accelerator 4 and the yarn tension device 5 as indicated by the solid line position suction mouth 26' in FIG. 3. Shortly before reaching its yarn end engaging position, the supply package yarn engaging member 25 passes through its lowermost portion of its arc of pivoting, as indicated by the broken line position 25' in FIG. 3 and suction is applied through the supply package yarn engaging member 25 beginning at this time.

As seen in FIGS. 4 and 5, upon the completion of their respective pivoting movements into their yarn end engaging positions, the take-up package yarn end engaging member 20 and the supply package yarn engaging member 25 are both applying suction and the yarn 3 extends along a restored travel path 3''' coincident with its travel path during a yarn winding operation, except that the yarn 3 extends over the top of the suction applying mouth 22. The yarn guiding contours of the textile winding station 1 such as, for example, the yarn guide 7 guides the yarn 3 and ensure that the yarn 3 again assumes its disposition in which it extends through the electronic yarn cleaning device 6 within the sensing region of the sensor therein and through the yarn tension device 5. At this point in the yarn re-establishment operation, the control unit 19 would normally initiate rotation of the take-up package 10 in an unwinding direction while suction continues to be applied through the suction applying mouth 22 of the take-up package yarn end engaging member 20 for engaging a yarn end extending from the take-up package 10. However, in accordance with the method of the present invention, a preliminary yarn sensing procedure is now implemented to provide the control unit 19 with sufficient information to determine if an actual yarn break has occurred or, alternatively, that the yarn 3 extends in a still unbroken condition between the supply package 2 and the take-up package 10.

The preliminary yarn sensing step of the method of the present invention involves querying the sensor of the electronic yarn cleaning device 6 by the control unit 19 to detect the presence or absence of yarn at the sensing location of the electronic yarn cleaning device 6 at a predetermined time after the initial pivoting movement of the take-up package yarn end engaging member 20 (or the supply package yarn engaging member 25) has begun and before the step of orienting a yarn end for the pre-splicing sensing step. The preliminary yarn sensing step is different than a later occurring sensing step, which may be referred to as a pre-splicing sensing step, during which a yarn end engaged by one of the take-up package yarn end engaging member 20 or the supply package yarn engaging member 25 is sensed by the sensor of the electronic yarn cleaning device 6 to verify that the respective take-up package yarn end engaging member 20 or supply package yarn engaging member 25 has, in fact, engaged a yarn end from the respective supply package 2 or take-up package 10. Such a pre-splicing sensing step involves initially orienting an engaged yarn end in the electronic yarn cleaning device 6 for subsequent sensing by the sensor of the electronic yarn cleaning device 6 and, as will be described in more detail below, the orienting of the yarn end in the electronic yarn cleaning device 6 is accomplished by a pivoting movement of the take-up package yarn end engaging member 20 (or the supply package yarn engaging member 25) to pivot its suction applying mouth 22 (or its suction mouth 26, respectively) away from the respective package to thereby drawn an engaged yarn end from the respective package and dispose the engaged yarn end in the splicing device 14. In contrast, the preliminary sensing step involves sensing the presence or absence of the yarn 3 at a period of time before any yarn end has been oriented for sensing by the sensor of the electronic yarn cleaning device 6 in connection with splicing of two yarn ends together.

Accordingly, the sensor of the electronic yarn cleaning device 6 senses the presence or absence of the yarn 3 during the specified time interval. As seen in FIGS. 4 and 5, the preliminary sensing step is preferably executed in correspondence with the time at which the suction applying mouth 22 of the take-up package yarn end engaging member 20 or the suction mouth 26 of the supply package yarn engaging member 25 is disposed in its yarn end engaging position at which it applies suction to the respective package for drawing a yarn end therefrom.

In the situation illustrated in FIGS. 2–5, the yarn 3 is in its still unbroken condition and, as described above, has been re-oriented into alignment with its travel path by the pivoting motion of the take-up package yarn end engaging member 20 to dispose its suction applying mouth 22 at its yarn end engaging position. Moreover, the yarn 3, in its still unbroken condition, extends through the electronic yarn cleaning device 6 and the sensor thereof accordingly signals the control unit 19 that it senses the presence of a yarn thereat. In contrast, in a situation in which an actual break in the yarn 3 has occurred, no yarn would extend from the take-up package 10 to the supply package 2 during this time in the yarn re-establishment operation and, accordingly, the sensor of the electronic yarn cleaning device 6 would signal the control unit 19 that no yarn is present.

Figure 6:
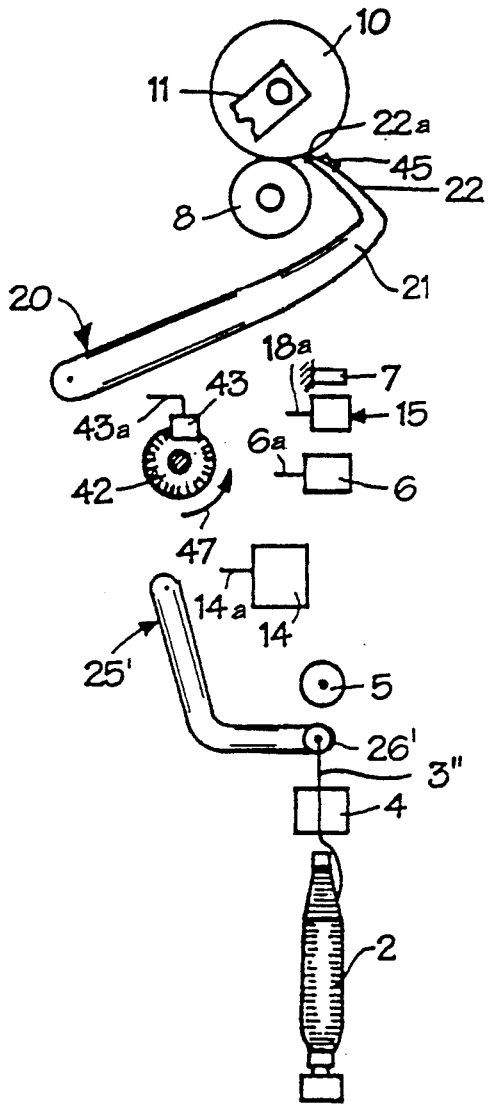
FIG. 6 is a side elevational view of the portion of the textile winding station shown in FIG. 1 at a time following the cutting of a yarn to create two yarn ends after a falsely reported yarn break situation has been determined.

The control unit 19 is configured to evaluate the sensing information received from the sensor of the electronic yarn cleaning device 6 in such a way that the steps subsequently undertaken during the yarn re-establishment operation are different for the situation in which an actual yarn break has occurred, as compared with the situation in which the yarn 3 still extends in its unbroken condition from the supply package 2 to the take-up package 10. If the sensor of the electronic yarn cleaning device 6 has indicated to the control unit 19 that yarn is present during the preliminary sensing step, the control unit 19 evaluates this information in connection with the information received from the pivotal movement measuring device 43 which indicates to the control unit 19 that the suction applying mouth 22 of the take-up package yarn end engaging member 20 is in its yarn end engaging position adjacent the take-up package 10. The control unit 19 evaluates these two pieces of information as an indication that the yarn 3 has not experienced an actual yarn break but, instead, is in its still unbroken condition according to the logic that if, there had, in fact, been a break in the yarn 3, the sensor of the electronic yarn cleaning device 6 would indicate the absence, rather than the presence, of yarn at the point in time at which the suction applying mouth 22 of the take-up package yarn end engaging member 20 is disposed adjacent the take-up package 10 in its yarn end engaging position. While the initial signal received from the sensor of the electronic yarn cleaning device 6 had been evaluated by the control unit 19 as an indication that a yarn break has occurred (and the control unit 19 had correspondingly implemented a yarn re-establishment operation in accordance with this assumption), the control unit 19 now disregards or overrules the earlier signal received from the sensor of the electronic yarn cleaning device 6 and, instead, proceeds with its control of the yarn re-establishment operation under the assumption that the yarn 3 is still in its unbroken condition. The further steps of the yarn re-establishment operation now implemented by the control unit 19 include controlling the actuation device 18 by the connector **18*a* to extend the movable portion 17 toward the anvil portion 16 to thereby cut the yarn 3 at that location. Once the yarn 3 is cut, the cut portion thereof extending to the supply package 2 falls downwardly due to the action of gravity out of the electronic yarn cleaning device 6. However, since suction continues to be applied through the supply package yarn engaging member 25 during the yarn cutting operation, the cut yarn end extending from the supply package 2 is drawn into the conduit 27 of the supply package yarn engaging member 25. Likewise, the cut yarn end extending from the take-up package 10 is drawn into the conduit 21 of the take-up package yarn end engaging member 20 as suction is applied through the take-up package yarn end engaging member 20 as well during the yarn cutting operation. FIG. 6 illustrates the condition of the textile winding station 1 at the time immediately following the cutting of the yarn 3 by the movable portion 17 and the anvil portion 16**.

Following cutting of the yarn, the sensor of the electronic yarn cleaning device 6 signals the control unit 19 to indicate that it no longer senses the presence of yarn and, in response to the signal, the control unit 19 further implements the yarn re-establishment operation by controlling the take-up package yarn end engaging member 20 to pivot in a clockwise direction, as seen in FIG. 4, to bring the yarn end extending from the take-up package 10 to a position for splicing with the yarn end extending from the 2. The control unit 19 also controls the supply package yarn engaging member 25 to pivot in a counterclockwise direction as seen in FIG. 4 to dispose the yarn end drawn thereinto the splicing device 14 for splicing with the yarn end extending from the take-up package 10. Once both the yarn end extending from the take-up package 10 and the yarn end extending from the supply package 2 have been disposed in the splicing device 14; the control unit 19 controls the splicing device 14 to splice the two yarn ends together to thereby again place the yarn 3 in an unbroken condition. Subsequently, the control unit 19 controls the drive motor 11 to restart the traverse winding movement of the traverse winding drum 8 and the yarn winding operation resumes.

Although the steps of the yarn re-establishment operation implemented by the control unit 19 following its evaluation that the yarn 3 had not, in fact, broken but was still in its unbroken condition ultimately lead to the same result as if the yarn 3 were never cut—i.e., the yarn 3, following the splicing operation, is in an unbroken condition—the re-establishment of the yarn winding operation in accordance with the method of the present invention ensures that operational problems do not occur which would otherwise occur if the yarn had never been cut. For example, if the yarn were not cut and the suction applying mouth 22 of the take-up package yarn end engaging member 20 were pivoted away from its yarn engaging position in a counterclockwise manner as seen in FIG. 4 to return to its non-engaging position, the slack portion of the yarn 3 which had been drawn into the conduit 21 would still be retained in the conduit 21 and the yarn would, thus, not extend in a desirably taught manner between the take-up package 10 and the supply package 2. Accordingly, upon restarting of the traverse winding operation of the traverse winding drum 8, tangles or snarls may result. Also, if the yarn 3 were not cut and then restored to an unbroken condition by the splicing operation, the slack portion of the yarn 3 which has been drawn into the suction applying mouth 22, which may be in the form of a loop, may be wound on the take-up package 10 upon the resumption of the yarn winding operation and thereby create a defective yarn package. Moreover, the yarn 3 may not be properly aligned in its travel path if the yarn re-establishment operation were to proceed without cutting of the yarn and this would immediately or shortly lead to yet another signal from the sensor of the electronic yarn cleaning device 6 indicating that the yarn 3 is no longer detected.

Within the scope of the method of the present invention, the parameters of the preliminary sensing step can be varied for optimization of the yarn re-establishment operation. For example, the time at which the control unit 19 queries the sensor in the electronic yarn cleaning device 6 as to the presence or absence of the yarn during the preliminary sensing step has been described as responsive to an indication from the pivotal movement measuring device 43 indicating that a predetermined number of the circumferential markers of the disk 42 have traveled past one or both of the disk readers of the pivotal movement measuring device 43. However, the control unit 19 can also be configured to begin its query of the sensor of the electronic yarn cleaning device 6 at a point in time prior to the completion of the movement of the suction applying mouth 22 into its yarn end engaging position and, additionally, to continue its query of the sensor of the electronic yarn cleaning device 6 for a predetermined length of time after the pivotal movement measuring device 43 has indicated by the suction applying mouth 22 of the take-up package yarn end engaging member 20 has reached its yarn end engaging position. Furthermore, the control unit 19 can be configured to end its query of the sensor of the electronic yarn cleaning device 6 in response to a signal from the pivotal movement measuring device 43 indicating that the suction applying mouth 22 has begun its clockwise pivoting to pivot the suction applying mouth 22 thereof from its yarn end engaging position back to its non-engaging position.

Additionally, although the method of the present invention has been described with respect to FIGS. 1–6 as including the steps of reading and evaluating the incremental angular movement of a disk mounted on the shaft 32 of the cam drive motor 33, the present invention also contemplates that other movement or time indicating devices can be used with equal effect to provide the control unit 19 with the information to which the control unit 19 can respond by initiating its query of the sensor of the 6. For example, the pivotal movement of the take-up package yarn end engaging member 20 or the supply package yarn engaging member 25 can be analogously detected by monitoring the operating characteristics of a controlled step motor such as, for example, the accumulated revolutions per unit time of the step motor.

Figure 7:
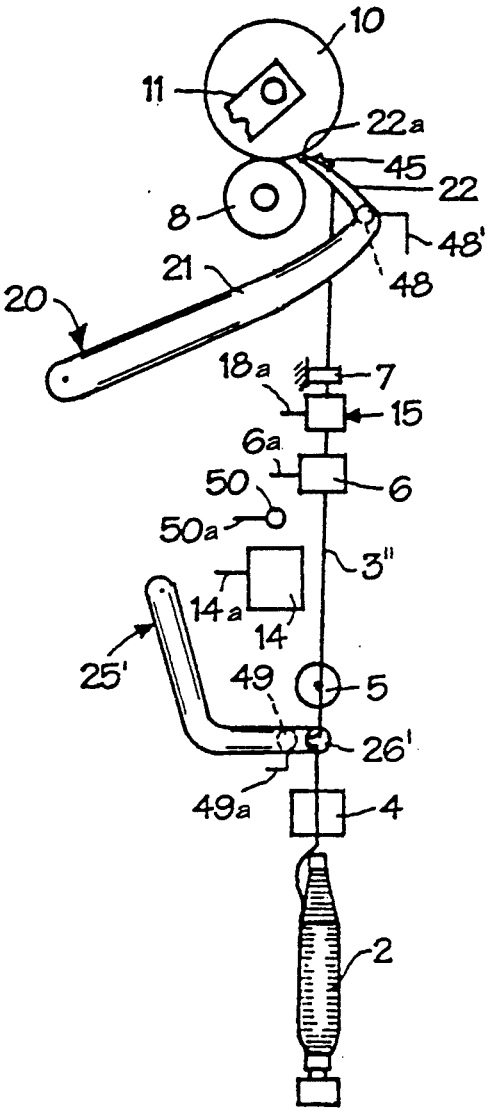
FIG. 7 is a side elevational view of a variation of the portion of the textile winding station shown in FIG. 1 and showing a sensing device for sensing the disposition of the take-up yarn package yarn end engaging member in its yarn end engaging position.

In FIG. 7, a variation of the preferred embodiment of the yarn break verification apparatus of the present invention is illustrated. In this variation, a sensor 48 is additionally provided which is operatively connected via a connector sensor 48′ to the control unit 19. The sensor 48 is disposed adjacent the travel path of the conduit 21 of the take-up package yarn end engaging member 20 for sensing the presence of the conduit 21 at the time at which the suction applying mouth 22 of the conduit 21 has reached its yarn engaging position adjacent the take-up package 10. The sensor 48 signals the control unit 19 via the sensor 48′ that it has detected the conduit 21 and the control unit 19 evaluates this information as an indication that it can now begin its query of the sensor of the electronic yarn cleaning device 6 concerning the presence or absence of yarn during the preliminary sensing step.

A sensor 50 is also provided in this variation of the yarn end verification apparatus and is operatively connected via a connector sensor 50*a* to the control unit 19. The sensor 50 is disposed relative to the travel path of the supply package yarn engaging member 25 for sensing the supply package yarn engaging member 25 when it has completed its movement during which it disposes a yarn end extending from the supply package 2 in the splicing device 14. The control unit 19 evaluates a signal from the sensor 50 indicating the presence of the supply package yarn engaging member 25 as an indication that the take-up package yarn end engaging member 20 and the supply package yarn engaging member 25 have each disposed a yarn end in the splicing device 14 so that the control unit 19 can control the splicing device 14 to execute a splicing operation.

The control unit 19 can be configured to end its query of the sensor in the electronic yarn cleaning device 6 during the preliminary sensing step in response to the receipt of a signal from the sensor 48 indicating that the sensor 48 no longer detects the suction applying mouth 22. The sensor 48 will no longer detect the presence of the suction applying mouth 22 after the take-up package yarn end engaging member 20 has been pivoted through a predetermined degree of movement during its clockwise pivoting to bring the suction applying mouth 22 downwardly toward the splicing device 14 for disposing a yarn end therein.

If desired, a sensor can be disposed interiorly of the suction applying mouth 22 adjacent the opening 22*a* for sensing the presence of a yarn drawn into the suction applying mouth 22. In this configuration, the control unit 19 would end its query of the sensor in the electronic yarn cleaning device 6 in response to a signal from the sensor within the suction applying mouth 22 indicating that a yarn end has been drawn therein. Furthermore, sensors can be provided to control the application of suction through the suction applying mouth 22 as well as the suction mouth 26.

In the situation in which an actual break in the yarn 3 has occurred, the yarn 3 does not extend in an unbroken condition between the supply package 2 and the take-up package 10 and, accordingly, the sensor in the electronic yarn cleaning device 6 responds to the query of the control unit 19 during the preliminary sensing step by indicating that no yarn has been detected. Based on this information, the control unit 19 controls the take-up package yarn end engaging member 20 and the supply package yarn engaging member 25 to execute their yarn end disposing operations in which they each dispose a yarn end in the splicing device 14 and the control unit 19 then controls the splicing device 14 to splice the disposed yarn ends together to again restore the yarn 3 to its unbroken condition. Consequently, in the situation in which the sensor in the electronic yarn cleaning device 6 fails to detect the presence of yarn in the preliminary sensing step, the control unit 19 implements the remaining steps of the yarn re-establishment operation based on the assumption that the initial signal from the sensor in the electronic yarn cleaning device 6 indicating a yarn break was, in fact, an accurate signal since an actual yarn break did occur. The control unit 19 therefore does not control the actuation device 18 to extend the movable portion 17 into cutting engagement with the yarn 3 following the preliminary sensing step. Instead, the control unit 19 directly implements pivoting movement of the take-up package yarn end engaging member 20 and the supply package yarn engaging member 25 to dispose their respective yarn ends in the splicing device 14.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Method of operating a textile winding station to wind yarn packages, the textile winding station being operable to unwind yarn from a supply package onto a take-up package during a yarn winding operation, comprising:

winding yarn from the supply package onto the take-up package in a yarn winding operation which includes guiding yarn relative to a sensing device during its travel from the supply package to the take-up package for sensing of the presence of the yarn;

ceasing the winding of yarn from the supply package to the take-up package in response to the sensing of an out-of-limits condition of the yarn by the sensing device;

initiating movement of a yarn end engaging member toward a yarn engaging position for subsequent engagement of a yarn end extending from a respective one of the supply and take-up packages following the ceasing of the winding of yarn;

controlling the yarn end engaging member to engage yarn while the yarn end engaging member is disposed in its yarn end engaging position such that the yarn end engaging member draws in a portion of a yarn which extends to both the supply package and the take-up package in the event the yarn is still in an unbroken condition after the ceasing of the winding of yarn or draws in a yarn end from the respective one package in the event that the yarn is in a broken condition after the ceasing of the winding;

preliminarily sensing the presence or absence of yarn at a sensing location after initiating movement of the yarn end engaging member toward its yarn engaging position and before orientation of a yarn in a splicing device for splicing a yarn end extending from the supply package together with a yarn end extending from the take-up package;

if no yarn is preliminarily sensed during the preliminarily sensing of yarn, orienting the yarn end extending from the one respective package into the yarn end engaging member in the splicer, orienting a yarn end from the other package in the splicer and splicing the pair of oriented yarn ends in the splicer together to restore the yarn to an unbroken condition; and if yarn is sensed during the preliminary sensing of yarn, cutting the unbroken yarn extending between the supply and take-up packages to thereby create a pair of yarn ends each extending from a respective package, orienting the pair of yarn ends in the splicer and operating the splicer to splice the oriented yarn ends together to again restore the yarn to its unbroken condition.

2. A method of operating a textile winding station according to claim 1 and further comprising detecting a positional characteristic of the yarn end engaging member and preliminarily sensing the presence or absence of yarn at the sensing location in response to the detection of a predetermined value of the positional characteristic of the yarn end engaging member.

3. A method of operating a textile winding station according to claim 2 wherein detecting a positional characteristic of the yarn end engaging member includes sensing the presence or absence of the yarn end engaging member at a predetermined position.

4. A method of operating a textile winding station according to claim 3 wherein detecting a positional characteristic of the yarn end engaging member includes detecting a characteristic of an incremental position indicating device which moves in correspondence with the movement of the yarn end engaging member.

5. A method of operating a textile winding station according to claim 1 wherein preliminarily sensing the presence or absence of yarn includes preliminarily sensing such presence or absence or yarn during a period of time commencing upon the movement of the yarn end engaging member from a first predetermined position and ending upon the movement of the yarn end engaging member past a second predetermined position.

6. A method of operating a textile winding station according to claim 1 wherein preliminarily sensing the presence or absence of yarn includes sensing the presence or absence or yarn for a period of time corresponding to the period of time during which the yarn end engaging member is disposed in a predetermined position.

7. A method of operating a textile winding station according to claim 6 wherein preliminarily sensing the presence or absence of yarn is conducted for a period of time corresponding to the period of time during which the yarn end engaging member is disposed at its yarn end engaging position.

8. A method of operating a textile winding station according to claim 1 wherein the yarn end engaging member is operable to engage a yarn end on the take-up package and preliminarily sensing the presence or absence of yarn includes sensing the presence or absence of yarn following the positioning of the yarn end engaging member in its yarn end engaging position adjacent the take-up package.

9. Apparatus for winding yarn from a supply package onto a take-up package, comprising:

means for rotating a take-up package to wind yarn thereon from a supply package;

a splicing device for splicing a yarn end extending from the take-up package with a yarn end extending from the supply package;

a sensing device for sensing the travel of yarn therethrough during travel of the yarn between the supply package and the take-up package;

means for cutting yarn extending between the take-up package and the supply package;

a take-up yarn end engaging member for engaging a yarn end extending from the take-up package and disposing the yarn end in the splicing device for splicing with a yarn end extending from the supply package, the take-up yarn end engaging member being sequentially movable from a non-engagement position in which it is out of interference with the yarn during travel thereof from the supply package to the take-up package to a yarn end engaging portion adjacent the take-up package for engaging a yarn end thereof, and subsequently to a splicer orienting position in which it disposes a yarn end engaged from the take-up package in the splicing device;

a supply yarn end engaging member for engaging a yarn end extending from the supply package and disposing the engaged yarn end in the splicing device for splicing with a yarn end extending from the take-up package; and means for controlling the yarn cutting device to cut the yarn in response to a signal from the sensing device indicating the presence of yarn at a time after the take-up yarn end engaging member has moved from its non-engagement position and before it has reached its splicer orienting position.

10. Apparatus for winding yarn according to claim 9 wherein the means for controlling the yarn cutting device includes means for controlling the yarn cutting device to cut the yarn in response to a signal from the sensing device indicating the presence of yarn at a time when the take-up yarn end engaging member is disposed in its yarn end engaging position.

11. Apparatus for winding yarn according to claim 9 and further comprising means for detecting the disposition of the take-up yarn end engaging member at a predetermined location.

12. Apparatus for winding yarn according to claim 11 wherein the disposition detecting means includes a detecting device positioned adjacent a predetermined extent of the travel path of the selected one yarn end engaging member and operatively connected to the means for controlling the yarn cutting device to signal the presence of the selected one yarn end engaging member thereat.

13. Apparatus for winding yarn according to claim 11 wherein the disposition detecting means includes means for detecting incremental uniform movement of the selected one yarn end engaging member.

14. Apparatus for winding yarn according to claim 11 and further comprising a pair of cams, each operatively connected to a respective one of the yarn end engaging members and the disposition detecting means includes means for detecting the position of at least one of the cams, the cam position detecting means being operatively connected to the means for controlling the yarn cutting device, and the means for controlling the yarn cutting device being operable to control the yarn cutting device to cut the yarn in response to a signal from the cam position detecting means.

15. Apparatus for winding yarn according to claim 9 wherein each yarn end engaging member includes means for pivoting the yarn end engaging member between a non-engaging position and its yarn end engaging position and further comprising means for applying suction to each yarn end engaging member to effect the drawing in of yarn into the yarn end engaging member.

16. Apparatus for winding yarn according to claim 10 wherein the take-up yarn end engaging member includes a guide contour for guiding a yarn to a travel path along which the yarn normally travels during a yarn winding operation.

* * * * *